US006829837B2

(12) United States Patent
Williams

(10) Patent No.: US 6,829,837 B2
(45) Date of Patent: Dec. 14, 2004

(54) MITER ANGLE INDICATING TOOL

(76) Inventor: Dan E. Williams, 2001 Elva St. #206, Mt. Pleasant, MI (US) 48858

( * ) Notice: Subject to any disclaimer, the term of this patent is extended or adjusted under 35 U.S.C. 154(b) by 0 days.

(21) Appl. No.: 10/337,547

(22) Filed: Jan. 7, 2003

(65) Prior Publication Data

US 2004/0040164 A1 Mar. 4, 2004

Related U.S. Application Data

(60) Provisional application No. 60/408,036, filed on Sep. 4, 2002.

(51) Int. Cl.[7] ..... B43L 7/10

(52) U.S. Cl. ..... 33/473; 33/1 AP

(58) Field of Search ..... 33/473, 194, 452, 33/453, 465, 472, 1 AP, 558.01, 558.4, 558.04

(56) References Cited

U.S. PATENT DOCUMENTS

| | | | | |
|---|---|---|---|---|
| 136,714 A | | 3/1873 | Fairbanks | |
| 323,077 A | | 7/1885 | Rice | |
| 368,434 A | | 8/1887 | Tiller | |
| 376,301 A | | 1/1888 | Gould | |
| 453,906 A | * | 6/1891 | James | 33/465 |
| 467,852 A | * | 1/1892 | Buckelew | 33/455 |
| 729,347 A | | 5/1903 | Hummel | |
| 886,639 A | | 5/1908 | Renner | |
| 928,569 A | | 7/1909 | Williams | |
| 1,125,770 A | | 1/1915 | Turgeon | |
| 1,135,743 A | | 4/1915 | Walker | |
| 1,159,569 A | | 11/1915 | Chancellor | |
| 1,230,901 A | | 6/1917 | Houghton | |
| 1,313,432 A | | 8/1919 | Walker | |
| 1,533,097 A | * | 4/1925 | Byhre | 33/473 |
| 1,983,516 A | | 12/1934 | Ahola | |
| 2,278,440 A | | 4/1942 | Graves | |
| 4,223,445 A | | 9/1980 | Goodland | |
| 4,562,649 A | | 1/1986 | Ciavarella | |
| 5,669,149 A | | 9/1997 | Meitzler | |
| 6,237,238 B1 | | 5/2001 | Shapiro | |
| 6,543,144 B1 | * | 4/2003 | Morin | 33/27.032 |

FOREIGN PATENT DOCUMENTS

| | | |
|---|---|---|
| DE | 195050 | 9/1906 |

* cited by examiner

*Primary Examiner*—Christopher W. Fulton
(74) *Attorney, Agent, or Firm*—Van Dyke, Gardner, Linn & Burkhart, LLP

(57) ABSTRACT

A miter angle indicating tool includes three members that are pivotally attached. The miter angle indicating member is adapted to display the miter angle in or around a corner requiring a miter joint, or to display the bisecting angle of an object. Once the required angle is displayed, the indicating tool can be used to either transcribe the angle onto the material that will form the miter joint or as a jig to set the cutting apparatus to the proper cutting position. In the preferred form of the tool, one member forms a case for storage of the other two members when not in use.

17 Claims, 4 Drawing Sheets

MITER ANGLE INDICATING TOOL

This application claims priority from provisional U.S. Pat. application Ser. No. 60/408,036, filed Sep. 4, 2002, which is incorporated herein in its entirety.

BACKGROUND AND TECHNICAL FIELD OF THE INVENTION

The present invention is directed towards a tool for use with construction projects. Although the invention may be used in many fields, such as plumbing, roofing, and drafting, it has particular relevance to the field of finish carpentry and will be discussed with respect thereto.

Carpenters must frequently join materials at an angle in a manner commonly known as a miter joint. A miter joint typically consists of two pieces of material that are joined at a corner, where each of the pieces is cut at a bisecting angle of the corner angle requiring the miter joint. Miter joints are used on molding surrounding doors, windows, and floor bases as well as in the risers and runs on staircase stringers. As doors, windows, walls, and staircases are frequently not perfectly square due to natural imperfections, the actual angle required for the miter joint must first be determined and then the materials cut to this angle.

Devices are known for measuring the required miter angle of a particular joint. These measuring devices typically consist of two members or legs that are joined at a pivot point. The measuring device is positioned within a corner requiring a miter joint and the members of the device are then pivoted such that they contact the surfaces of the corner that create the angle. A scale is provided on the device that, when the members are pivoted to the correct angle, enable the user to read the required miter angle for the corner. See, for example, U.S. Pat. No. 6,237,238 B1 issued to Shapiro. The required miter angle may then be set on the apparatus that will be used to cut the material to be joined. Alternatively, another device may be set to the required angle and used to scribe this angle onto the material to be joined. In this method the cutting apparatus is aligned to the mark on the material by sight.

However, problems exist with these methods with regards to translating the measured miter angle into a finish cut on the material to be joined. Imprecision between the gage scales of the device used for measuring the required miter angle and of the cutting apparatus can result in inaccurate miter cuts, resulting in miter joints that are not properly flush. Also, human imprecision is added when the operator must read one scale and transfer the value to another scale. Additionally, it is inefficient to set the angle on another device and use it to scribe the required angle onto the material to be joined.

The present invention overcomes such difficulties and enables the operator to accurately and efficiently determine a required miter angle for a given joint and directly transcribe that angle onto the material to be cut. By directly transcribing the angle onto the material to be cut, the cutting apparatus can be accurately adjusted by sight by aligning the cutting blade over the transcribed mark prior to cutting and any imprecision associated with the cutting apparatus' gage scale is avoided. Alternatively, the present invention can be used as a jig to set the cutting apparatus to the proper cutting position. Further, the tool is constructed such that miter angles for both internal corners and edge corners can be determined.

SUMMARY OF THE INVENTION

The present invention discloses a miter angle indicating tool which has an angle indicating blade, a bevel blade, and a case; all of which are pivotally attached to each other at their respective ends. The indicating blade is constructed with an indicating edge that aligns through the center point of the pivot point formed by the pivotal attachment of the indicating blade, the bevel blade, and the case.

In use, the tool is placed into or around a corner, and edges of the bevel blade and case are made to contact the surfaces comprising the corner. To obtain the miter or bisecting angle, the indicating blade is then positioned such that the indicating edge intersects a point established by the intersection of the interior edges of the bevel blade and case. When the tool is secured in this position, it can then be used to transcribe the miter angle onto a work surface or as a jig to set the cutting position of a cutting apparatus.

It is an object of this invention to provide an accurate indicator of the miter angle required for a work surface. It is a further object of this invention to avoid the inaccuracies and time delays associated with the reading of a gage scale on known miter angle measurement devices. It is still a further object of this invention to enable a miter angle to be transcribed onto a work surface or to provide a jig with which to set a miter angle cutting apparatus. These and other objects, features, and advantages of the invention will be made apparent from the following description and attached drawings.

DESCRIPTION OF THE PREFERRED EMBODIMENT

Figure 1:
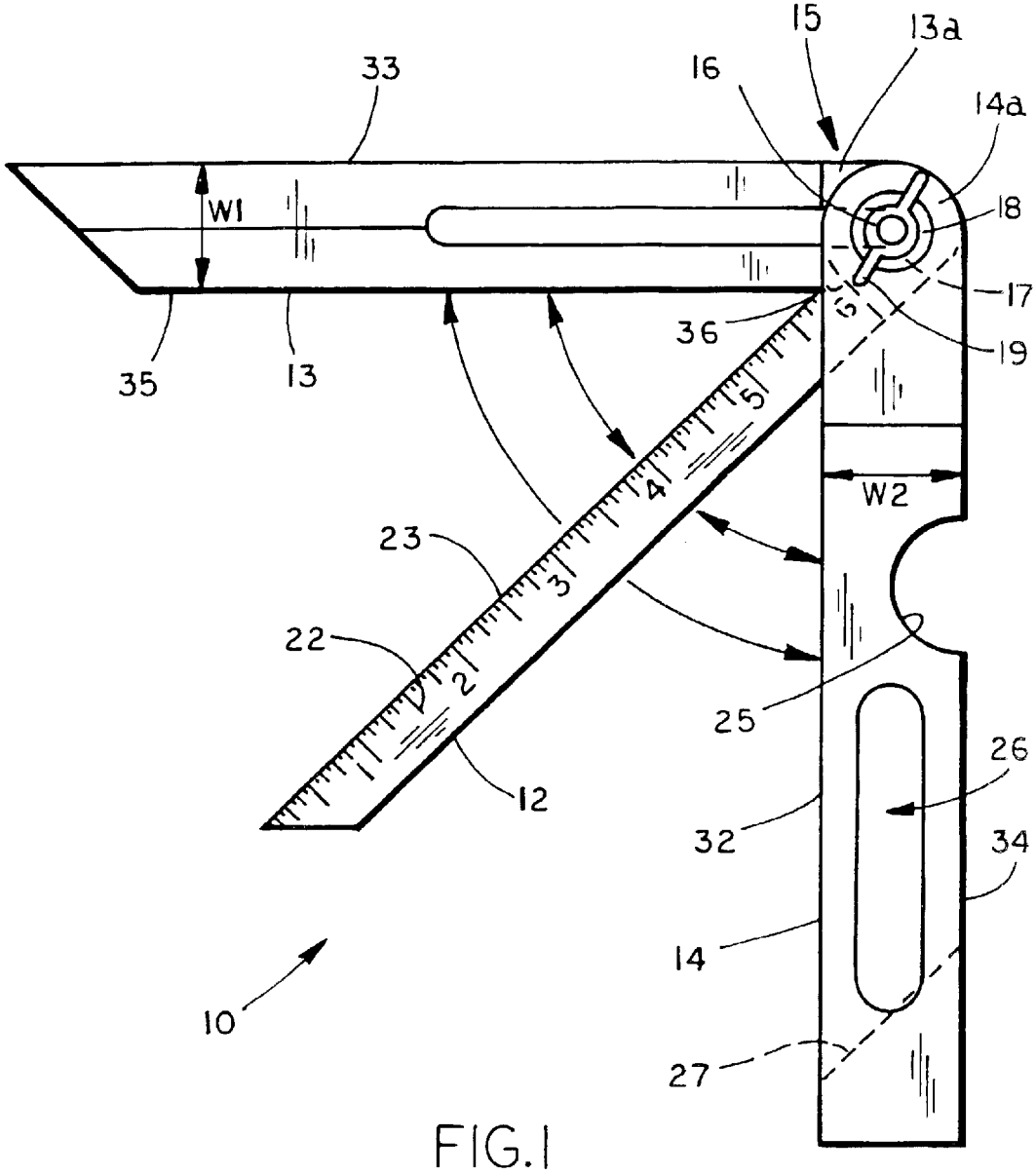
FIG. 1 is a plan view of one embodiment of the miter angle measuring and transcribing device in an open position.

As can be seen in FIGS. 1, 2A, 2B, 2C, 3A, 3B, and 3C, the preferred embodiment of the miter angle indicating tool 10 includes a first or miter angle indicator blade 12, a second or bevel blade 13, and a case 14. Indicator blade 12, bevel blade 13, and case 14 are pivotally connected at joint 15 by fastener assembly 16, which allows the indicator blade 12, bevel blade 13, and case 14 to be fixedly secured in a desired position, but also permits blades 12 and 13 to be pivoted to a closed position inside case 14. In the illustrated embodiment, indicator blade 12 is mounted on top of bevel blade 13 for ease of alignment as will be more fully described below.

Figure 2A:
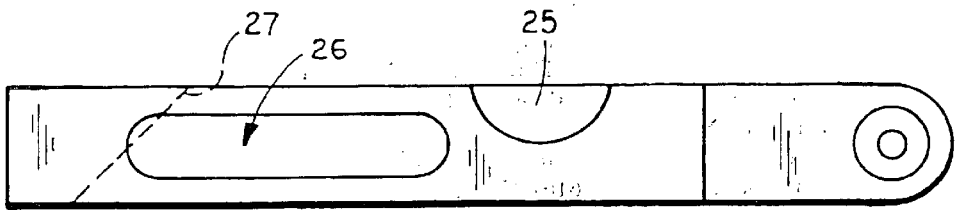
FIGS. 2A, 2B, and 2C show three orientations of the device in a closed position.
Figure 2B:
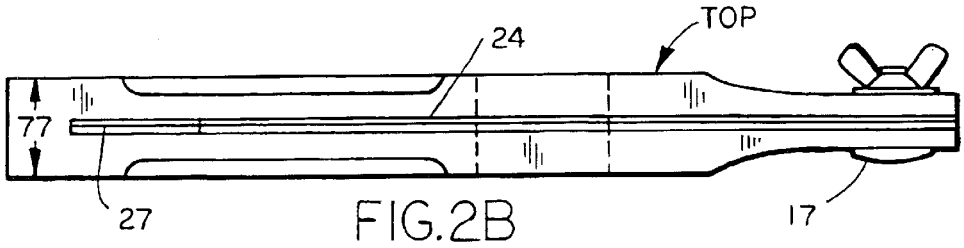
Figure 2C:
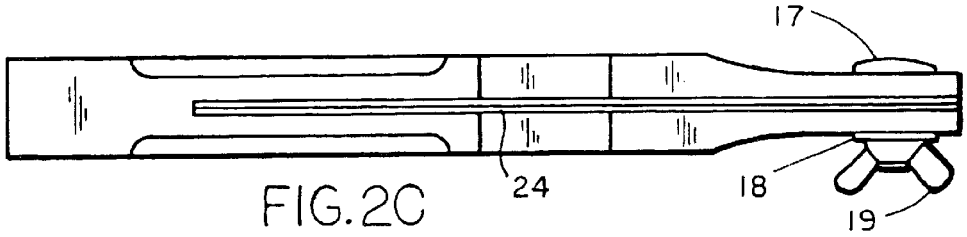

As best seen in FIGS. 2A–2C, fastener assembly 16 includes a bolt 17, a washer 18, and a wing-nut 19, with the bolt extending through openings provided in the proximal ends of case 14 and blades 12 and 13. Blades 12 and 13 are preferably elongated plate members and are preferably formed from a metal material, such as stainless steel, including high tempered steel, or aluminum. However, it should be understood that blades 12 and 13 may be formed from wood, plastic or a composite material or the like. Case 14 preferably comprises a plastic case and may be formed such as by molding or may be assembled from two or more plastic members. Similarly, case 14 may be formed from other materials, including metal, wood, or a composite material. Bevel blade 13 and case 14 are constructed to have commensurate widths W1, W2, and also have rounded ends 13*a* and 14*a* at joint 15. Indicator blade 12 also has a rounded end 12*a* (FIG. 3A) at joint 15 and includes measuring scale 22, which can be used as a depth measurement tool or just as a scale. Further, indicator blade 12 is constructed such that its edge 23 provides an indicating edge, which aligns with the center point of joint 15. In this manner, as will be more fully described below, indicator blade 12 may be used to determine the miter angle on a corner or edge.

Referring to FIGS. 2B and 2C, case 14 includes slot 24 into which indicator blade 12 and bevel blade 13 can be pivoted and housed when not in use. Additionally, case 14 has notch 25 on its outer edge that is in communication with slot 24 and exposes indicator blade 12 and bevel blade 13 when they are housed within slot 24, and in turn aids in the removal of indicator blade 12 and bevel blade 13 from slot 24 when they are needed. In the illustrated embodiment, slot 24 may comprise a through-slot or may comprise a slotted recess, as will be noted below. In addition, to ease handling of tool 10, tool 10 may be provided with one or more grips 26, such as indentations, located on either side of case 14. Grips 26 especially facilitate handling of tool 10 when in operation.

Optionally, case 14 also includes a stop to limit the position of blades 12 and 13 in case 14. For example, in the illustrated embodiment the stop comprises an angled support area 27 formed within slot 24 that contacts the distal ends of blades 12 and 13. Optionally, the distal ends of blades 12 and 13 are pointed, such as defined by pointed edge 28 of indicator blade 12 and pointed edge 29 of, bevel blade 13. Thus, when blades 12 and 13 are housed within slot 24, edges 28 and 29 are retained in slot 24 by support area 27. In this manner, blades 12 and 13 cannot pass through case 14 and, instead, are retained in slot 24 by the stop formed by support area 27. Alternately, the stop may be formed by a closed side of case 14, such as when slot 24 comprises a slotted recess and does not extend through case 14—in which case distal ends of blades 12 and 13 may be flat or "squared-off".

Figure 3A:
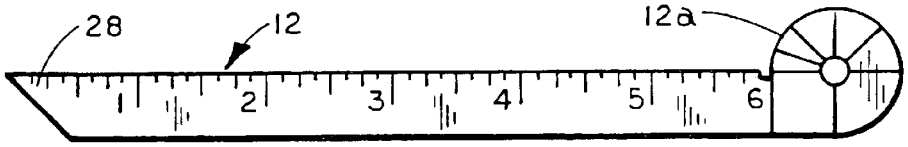
FIG. 3A is a plan view of the miter angle blade member from the embodiment of FIG. 1.
Figure 3B:
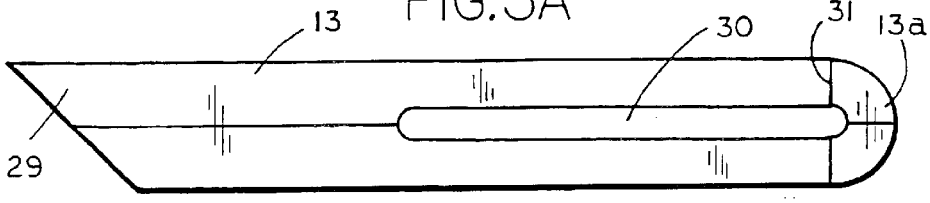
FIG. 3B is a plan view of the bevel blade of member from the embodiment of FIG. 1.
Figure 3C:
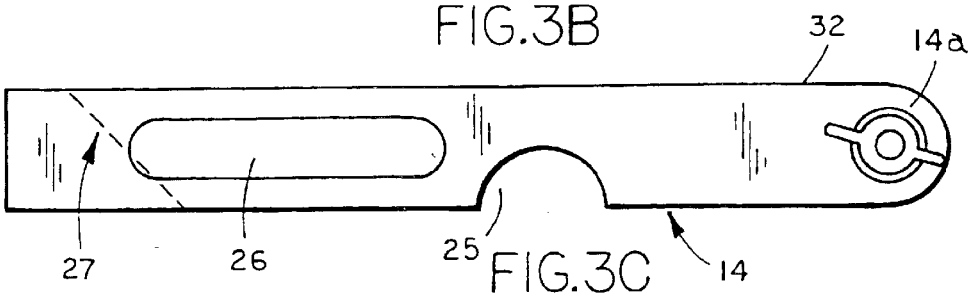
FIG. 3C is a plan view of the case member from the embodiment of FIG. 1.

Referring to FIG. 3B, bevel blade 13 includes an elongate opening 30 that enables tool 10 to be used as a bevel by allowing bevel blade 13 to slide and rotate relative to joint 15. As bolt 17 passes through opening 30, bevel blade 13 is constrained and only free to slide a distance defined by the length of opening 30. Bevel blade 13 also includes indicating line 31 that can be aligned with edge 32 of case 14 such that a 90° angle is established between bevel blade 13 and case 14 when indicating line 31 is aligned with edge 32.

In operation, tool 10 can be used, amongst other ways, to create a miter joint at a corner. Ends 12*a*, 13*a*, 14*a* of the indicator blade 12, bevel blade 13, and case 14 are positioned in or along a corner to where the surfaces comprising the corner meet. Edge 33 of bevel blade 13 and edge 34 of case 14 are then made to contact the surfaces comprising the corner. When bevel blade 13 and case 14 are positioned in this manner, it can be seen that inner edge 35 of bevel blade 13 and inner edge 32 of case 14 intersect at point 36. Indicator blade 12 can then pivotally positioned such that indicator edge 23 also intersects the intersection of inner edge 35 of blade 13 and inner edge 32 of case 14 at point 36. Once edge 23 is set to intersect point 36, wing-nut 19 is preferably tightened such that the relative positions of indicator blade 12, bevel blade 13, and case 14 are fixed.

When tool 10 is fixed in this manner, the angle defined by edges 23 and 35 or 13 and 32 is the miter or bisecting angle of the corner. Tool 10 can then be used to scribe the miter angle onto the material that will form the miter joint such that two pieces of the material cut at the miter angle will create an accurate miter joint for the corner. Alternatively, tool 10 can be used as a jig to set the position of the cutting apparatus that will put the miter angle on the material to be joined in or around the corner.

The thickness T1 (FIG. 2B) of case 14 also provides support for tool 10 during operation. When positioning case 14 in or around a corner, edge 32 or edge 34 will prevent wobbling by providing sufficient surface area to contact one of the surfaces comprising the corner. It should be understood that case 14 may be formed from a single member or a plurality of members, which are interconnected using conventionally fasteners, welds, or the like.

Figure 4:
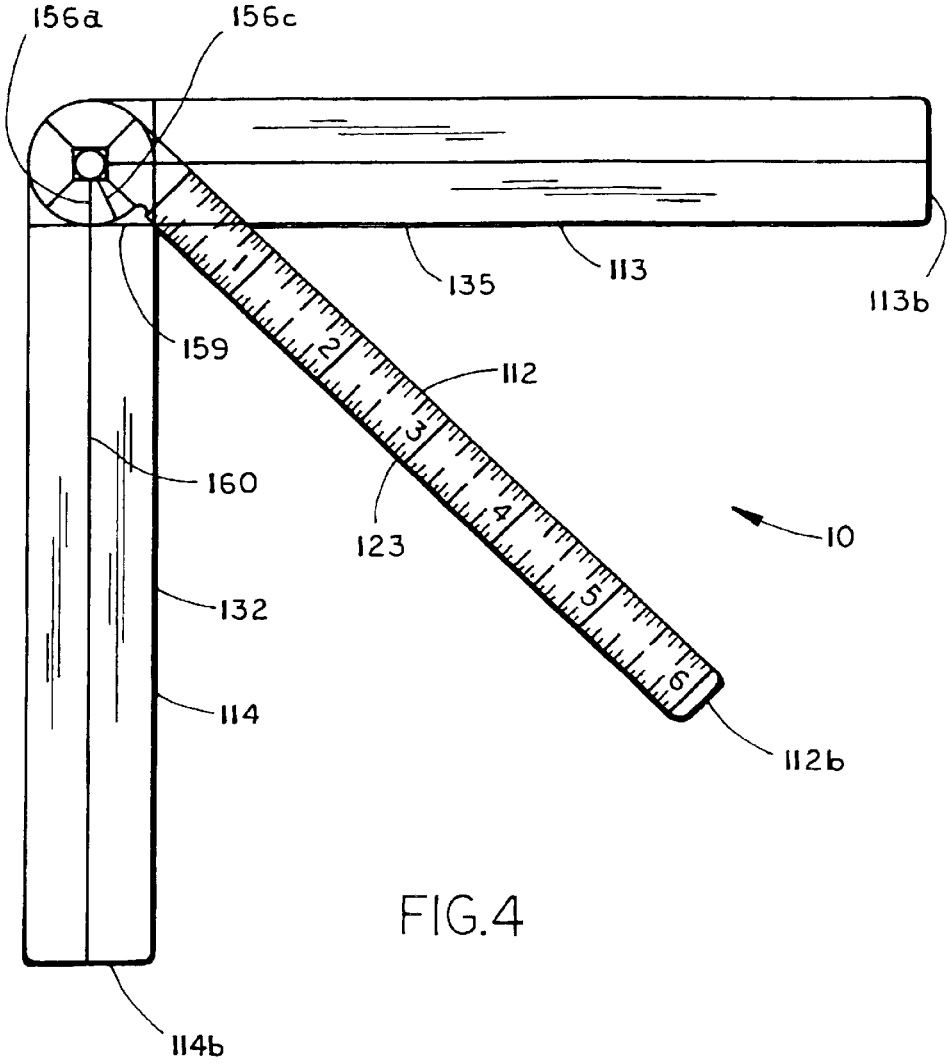
FIG. 4 is a plan view of another embodiment of the present invention shown in an open position.
Figure 5A:
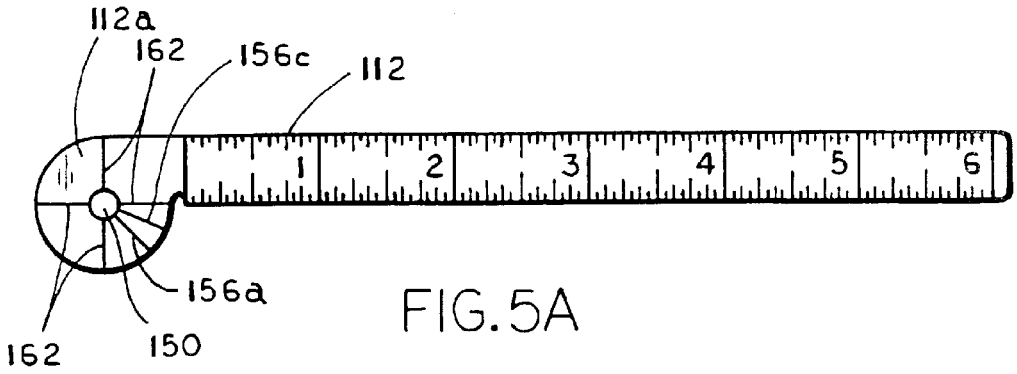
FIG. 5A is a plan view of the miter angle blade member of the embodiment of FIG. 4.
Figure 5B:
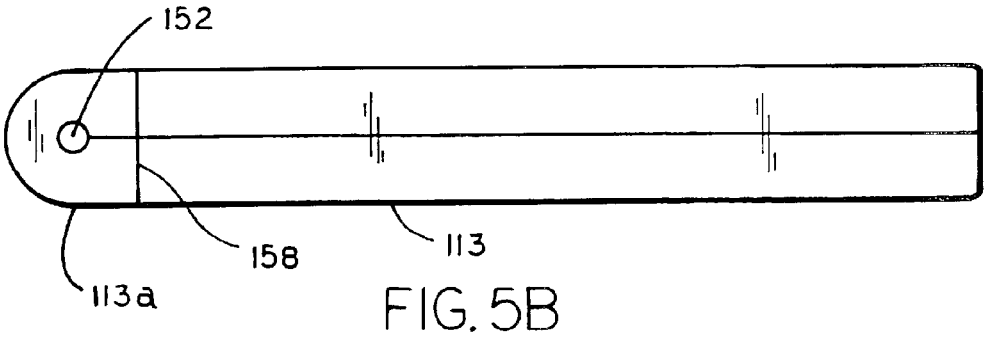
FIGS. 5B and 5C show the middle and bottom blade members of the embodiment of FIG. 4.
Figure 5C:
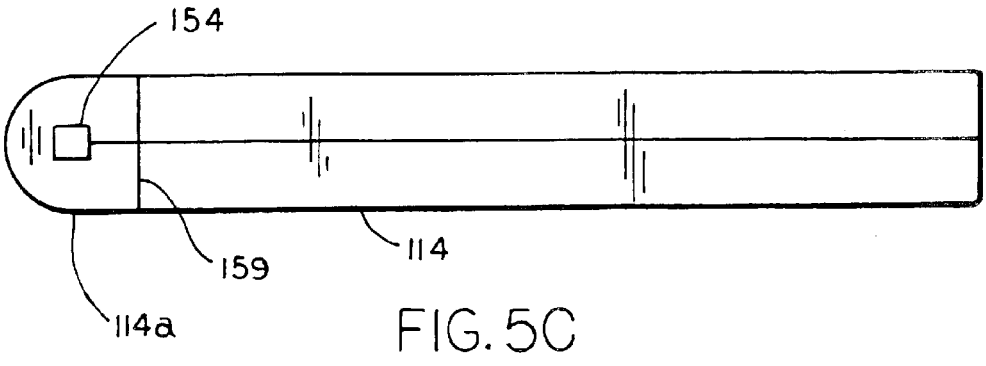

FIGS. 4 and 5 show an alternative embodiment of the miter angle indicating tool 110. Tool 110 includes a miter angle indicator blade 112, a first bevel or middle blade 113, and a second bevel or bottom blade 114, which are pivotally connected at the proximal ends 112*a*, 113*a*, and 114*a* at joint 115. In this embodiment, as shown in FIG. 5D, indicator blade 112, first bevel blade 113, and second bevel blade 114 have substantially commensurate thicknesses T2, T3, and T4. In addition, the width of blades 113 and 114 are also approximately equal. However, it should be understood that the thickness of the respective blades and widths o the blades may vary. In addition, similar to the previous embodiment, the proximal ends of blades 112, 113, and 114 may be rounded so that the tool may used to fit for an inside angle measurement. Also, preferably to ease insert of tool 10 into a pocket of a user of tool 10, distal ends 112*b*, 113*b*, and 114*b* of blades 112, 113, and 114 are flat or squared off. Operation of the tool in this embodiment is substantially equivalent to the operation described above in connection with the tool illustrated in FIG. 1.

Indicator blade 112 has a round through-hole 150 at its proximal end 112*a*. First bevel blade 113 similarly has a round through hole 152 at proximal end 113*a*. Bottom blade 114, however, has square hole 154 at its proximal end 114*a* to permit blades 112 and 113 to be moved relative to blade 114, as will be more fully described below. Blades 112, 113, and 114 are secured together at joint 115 by a bolt (not shown) with a square shoulder, which is inserted through square hole 154 such that the square shoulder of the bolt prevents relative movement of second bevel blade 114 with respect to the bolt. First bevel blade 113 and indicator blade 112 are then placed over the bolt such that blade 113 is positioned between blade 114 and indicator blade 112. Further, blade 113 and indicator blade 112 are able to pivot relative to the bolt and blade 114. A washer and wing-nut (not shown) are then placed over the bolt and are tightened to secure the three blades 112, 113, and 114 such that relative motion of all three blades is limited when the tool 110 is not in use, or when the tool position is set, for example, when the miter angle of a given corner has been determined. It should be understood that the previous embodiment may also incorporate a square hole and corresponding fastener with a square shoulder to better enable the bevel blade and indicator blade to pivot with respect to the case.

Optionally, indicator blade 112, middle blade 113, and bottom blade 114 are constructed with indicating lines 156*a*,

156*b*, 156*c*, 158, and 159. Indicating lines 156*a*, 156*b*, 156*c*, 158 and 159 enable tool 110 to be adjusted to commonly used angles in the construction fields. For example, when indicating line 159 of bottom blade 114 is aligned with edge 135 of middle blade 113, a 90° angle is formed between blade 113 and middle blade 114. When indicating line 156*a* of indicator blade 112 is then aligned with indicating line 160 of bottom blade 114 a 45° angle will be formed between edge 123 of indicator blade 112 and edge 132 of blade 114. When indicating line 156*c* of blade 112 is aligned with indicating line 160, a 60° angle is formed between edge 123 of blade 112 and inner edge 135 of blade 113 and a 30° angle is formed between edge 123 of blade 112 and inner edge 132 of blade 114. It should be understood that blade 112 may include other indicator lines 152, for example at 0°, 90°, 180°, 270° with respect to edge 123.

I claim:

1. A device to determine a bisecting angle comprising:

a first member having an indicating edge, a proximate end, and a distal end;

a second member having an inner edge and proximate and distal ends;

a case having an inner edge and proximate and distal ends, wherein at least one of said distal ends comprises a flat distal end; and wherein said first member, said second member, and said case are pivotally connected at a pivot location at their proximal ends such that said first member is positioned between said second member and said case, and wherein said indicating edge of said first member aligns through a center point of said pivot location to provide a bisection of an angle formed between said inner edges of said second member and said case.

2. The device of claim 1, wherein said proximal ends of said second member and said case comprise rounded ends.

3. The device of claim 1, wherein said distal end of said first member includes a pointed distal end.

4. The device of claim 1, wherein said first member includes a measuring scale.

5. The device of claim 4, wherein said measuring scale is provided at said indicating edge.

6. The device of claim 1, wherein said distal end of said second member comprises a pointed distal end.

7. The device of claim 1, wherein said second member includes a central opening having a longitudinal extent extending along said second member.

8. The device of claim 1, wherein said second member includes at least one reference line.

9. The device of claim 8, wherein said reference line provides a guide to orient said second member to a specific angle.

10. The device of claim 1, wherein at least said first member and said second member have substantially commensurate thicknesses.

11. The device of claim 10, wherein said case has a thickness greater than said thicknesses of said first member and said second member over at least a portion of said case.

12. The device of claim 11, wherein said case includes a slot for receiving said first member and said second member to be housed within said case.

13. The device according to claim 12, wherein said case includes a stop for retaining said first and second members in said slot.

14. The device of claim 12, wherein said distal ends of said first member and said second member comprise pointed distal ends, and said stop providing an abutment for said pointed distal ends.

15. The device according to claim 14, wherein said stop comprises an angled surface.

16. The device of claim 12, wherein said case includes an opening in communication with said slot, said opening providing access to said first and second member wherein said first and second members can be pushed from said slot to an open position.

17. The device of claim 1, wherein said case includes at least one grip area to ease handling of said device.

* * * * *